United States Patent [19]

Petit et al.

[11] Patent Number: 4,469,385

[45] Date of Patent: Sep. 4, 1984

[54] MODULAR ELECTRICAL CONNECTION TERMINAL

[75] Inventors: André Petit, Longpont sur orge; Daniel Jamet, Nozay, both of France

[73] Assignee: Compagnie Industrielle des Telecommunications Cit-Alcatel, Paris, France

[21] Appl. No.: 413,320

[22] Filed: Aug. 31, 1982

[30] Foreign Application Priority Data

Sep. 4, 1981 [FR] France ..... 81 16840

[51] Int. Cl.[3] ..... H01R 13/631

[52] U.S. Cl. ..... 339/14 R; 339/75 MP; 339/176 M

[58] Field of Search ..... 339/14 R, 14 P, 136 M, 339/74 R, 75 M, 75 MP, 97 P, 176 M, 176 MP

[56] References Cited

U.S. PATENT DOCUMENTS

| | | | |
|---|---|---|---|
| 2,169,962 | 8/1939 | Del Camp | 339/143 R |
| 3,239,798 | 3/1966 | Silver | 339/176 |
| 3,277,426 | 10/1966 | Klostermann | 339/136 M |
| 4,008,939 | 2/1977 | Kinkaid et al. | 339/75 M |
| 4,176,900 | 12/1979 | Hines et al. | 339/75 MP |
| 4,208,083 | 6/1980 | Kirby | 339/97 P |
| 4,235,500 | 11/1980 | Belopavlovich et al. | 339/176 MF |
| 4,405,187 | 9/1983 | Muller et al. | 339/14 R |

FOREIGN PATENT DOCUMENTS

| | | | |
|---|---|---|---|
| 1262382 | 3/1968 | Fed. Rep. of Germany . | |
| 1395879 | 3/1965 | France . | |
| 124291 | 9/1979 | Japan | 339/75 MP |

*Primary Examiner*—John McQuade

*Attorney, Agent, or Firm*—Sughrue, Mion, Zinn, Macpeak & Seas

[57] ABSTRACT

A terminal for electrically connecting electrical conductors (6) to rigid electrical terminal pins (7) comprises a plurality of U-shaped individual contacts (2). One arm (20) of each contact (2) is connected to one of the conductors (6). The other arm (23) is flat and is adapted to connect to one of the pins (7). The terminal further comprises identical contact supports (1, 1') having an internal groove (10) with a rounded bottom. It has internal compartments (12) along the lateral walls of this groove (10) and external compartments along the lateral walls of each contact support (1, 1'). The internal compartments (12) accommodate the flat contact arms (23) and the respective pins (7). The external compartments accommodate the contact arms (20) adapted to contact the conductors (6). An insulating member (3) maintains the contact supports (1, 1') in alignment. A cylindrical rotary cam (5) has two diametrically opposed longitudinal flats adapted to simultaneously urge the flat contact arms (23) into contact with respective pins (7) in a "contact" position and to open the resulting electrical contacts in an "idle" position.

8 Claims, 8 Drawing Figures

MODULAR ELECTRICAL CONNECTION TERMINAL

BACKGROUND OF THE INVENTION

1. Field of the Invention

The present invention concerns electrical connections between conductors of an electrical cable and electrical terminal pins such as pins mounted on a printed circuit board and/or rigid electrical component leads, more particularly for connections between electrical equipment chassis, printed circuits, electronic components and electrical components with rigid connections.

Connections between conductors and rigid pins may be implemented using conventional wire-wrap technology.

The object of the present invention is to provide a modular connection terminal with which such connections may be made easily and quickly and providing also for making and breaking all the connections concerned as and when required.

2. Summary of the Invention

The invention consists in a modular terminal for electrically connecting electrical conductors of a cable to rigid electrical terminal pins, comprising: a plurality of generally U-shaped individual contacts each having one arm adapted to make contact via self-stripping edges with one electrical conductor and another and flat arm adapted to press on and make contact with one of said pins; at least one substantially parallelepipedal contact support comprising a longitudinal internal groove which opens onto its top surface and has a rounded bottom, a series of external compartments along each of its lateral surfaces parallel to said internal groove and a series of internal compartments along each of the longitudinal walls of said groove which open onto its bottom surface, each of said external compartments on one side of said groove receiving the arm of one of said contacts adapted to make contact with the electrical conductor and being aligned with one of said internal compartments on the other side of said groove accommodating said flat contact arm extending along the top of said internal compartment and the corresponding pin extending along the bottom of said internal compartment;

an insulating member fixed to each contact support and formed with an internal space at the top adapted to house electrical conductors of a cable; and a generally cylindrical rotary cam formed with two diametrically opposed flats, mounted in the groove in each support in contact with said flat contact arms and bearing on said rounded bottom of said groove, whereby said contacts are pressed simultaneously into contact with respective pins when the part-cylindrical portions of said cam are brought into contact with said flat contact arms.

Other objects and advantages will appear from the following description of an example of the invention, when considered in connection with the accompanying drawings, and the novel features will be particularly pointed out in the appended claims.

DESCRIPTION OF THE PREFERRED EMBODIMENT

Figure 1:
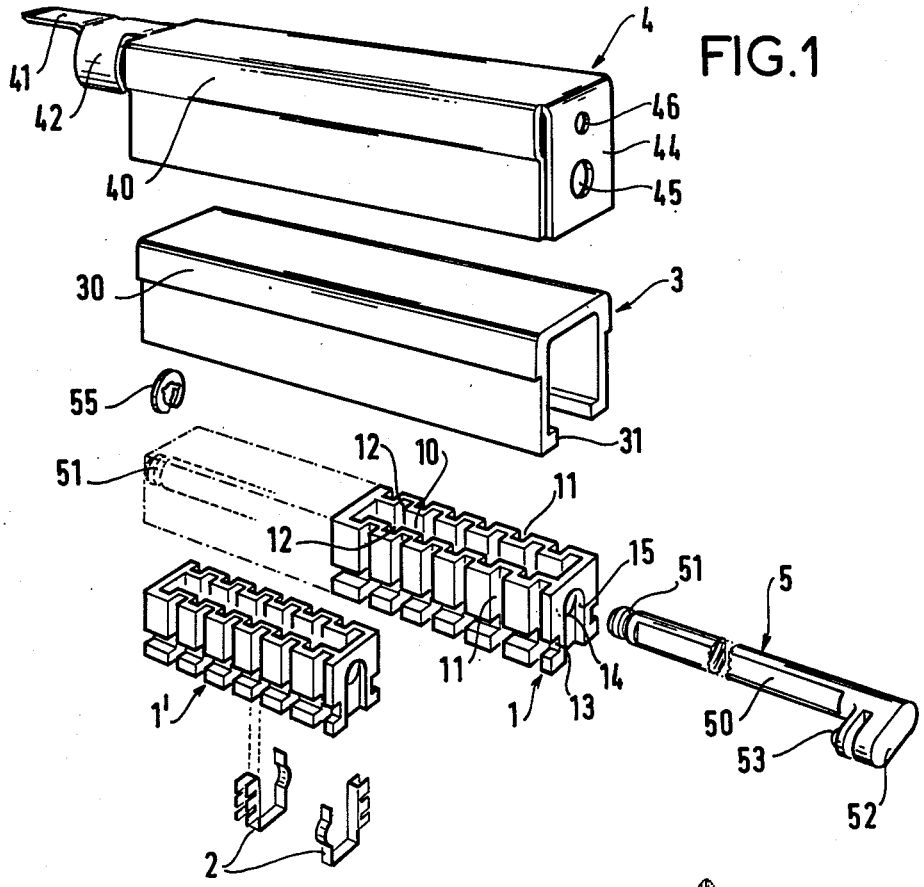
FIG. 1 is an exploded view in perspective of a modular electrical connection terminal in accordance with the invention.
Figure 3:
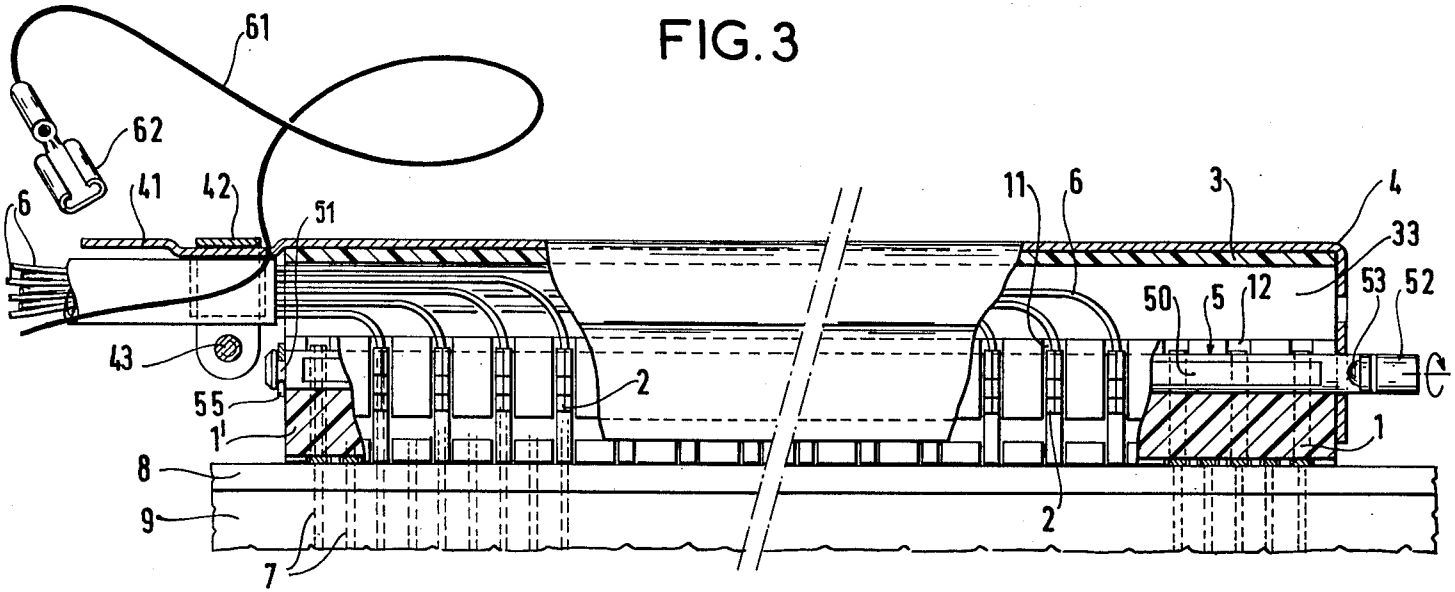
FIGS. 3 and 4 are respectively an elevation and plan view of the electrical connection terminal of FIG. 1, with the end portions shown in longitudinal cross-section.
Figure 4:
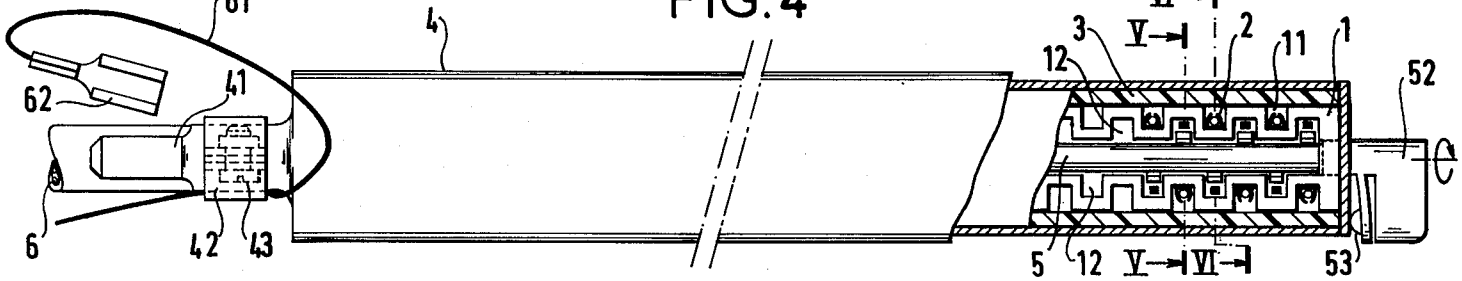

Referring in particular to FIGS. 1, 3 and 4, the electrical connection terminal in accordance with the invention is of modular design and comprises identical contact supports 1 and 1' each of which accommodates twelve contacts 2, an insulating member 3 for aligning contact supports 1 and 1', a cover 4 adapted to lock member 3 in position on the contact supports and a cam 5 mounted to rotate in contact supports 1 and 1' for simultaneous actuation of all contacts 2 so as to place same selectively in an "idle" or a "contact" position.

Figure 7:
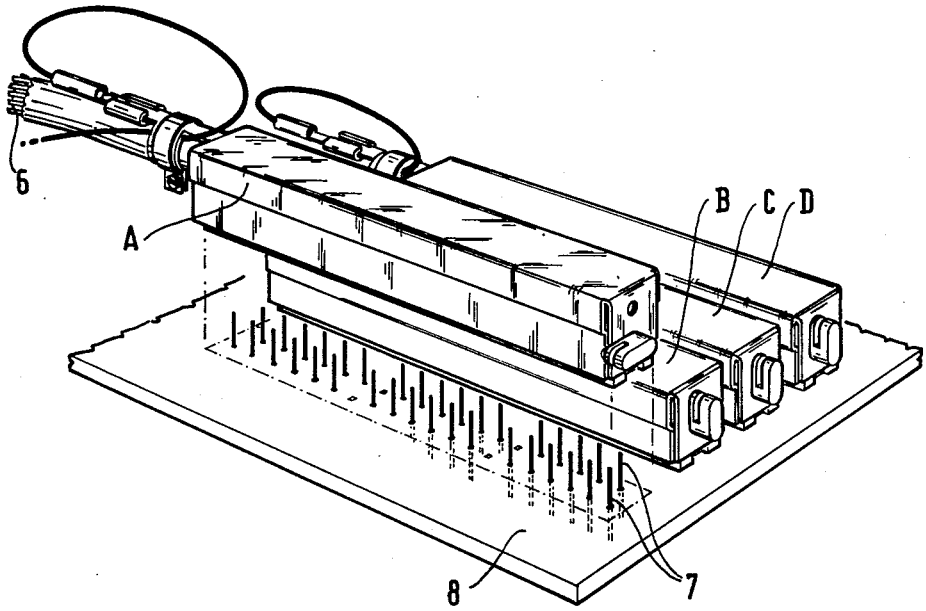
FIG. 7 shows the interconnection of one or more cables on an interconnecting printed circuit board.

Referring in particular to FIGS. 3 and 7, the terminal is adapted to provide the connection between electrical conductors 6 and aligned electrical contact pins 7.

Referring again to FIG. 1, each of contact supports 1 and 1' is in the form of an elongate parallelepipedal block with a longitudinal internal groove 10 which opens onto virtually the entirety of its top surface.

Each of supports 1 and 1' comprises along both its larger lateral surfaces six external compartments 11 extending over the full height of these larger lateral surfaces and disposed alternately in a staggered arrangement. Each further comprises along the longitudinal walls of groove 10 six internal compartments 12 extending to the bottom surface of the support. The six internal compartments 12 are interleaved between the six external compartments formed on the corresponding larger lateral surface of the support. In other words, they are aligned with respective ones of the six external compartments on the opposite larger lateral surface. The twelve internal compartments 12 in the support define with the twelve external compartments 11 in the same support housings for the twelve contacts 2 which each of supports 1 and 1' is adapted to accommodate.

Each of supports 1 and 1' also has a longitudinal groove 13 on each of its two larger lateral surfaces in the vicinity of the lower edge of these surfaces, intersecting the six external compartments 11.

The internal groove 10 in each of supports 1 and 1' has a depth of approximately half the height of the support and a rounded bottom 14. It defines a housing for cam 5, the rounded bottom forming a bearing surface therefor. Groove 10 opens onto the two smaller lateral surfaces, each of which has an arched opening 15 with the open side towards the bottom, the semi-circular tops of these arched openings and the rounded bottom of groove 10 limiting the available range of vertical movement of cam 5 in its housing.

Figure 2:
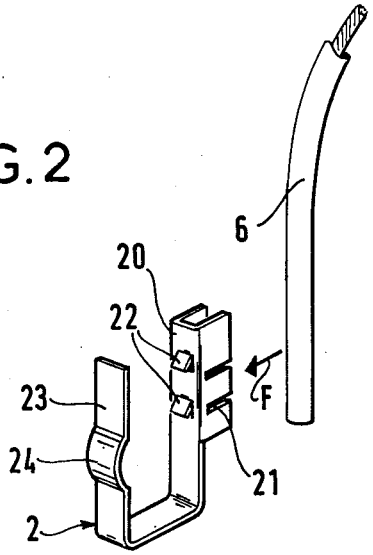
FIG. 2 is a perspective view of one of the contacts of the electrical connection terminal of FIG. 1 and the electrical conductor to be connected to it.

Supports 1 and 1' are of a plastics material, such as polycarbonate, for example. They are with advantage fabricated by molding. Contacts 2, one of which is shown to a larger scale in FIG. 2, are generally U-shaped spring contacts. Referring to FIG. 2 and/or FIGS. 5A, 5B and 6, one arm 20 of each contact 2 is adapted to be connected to sheathed conductor 6, making contact by virtue of self-stripping edges. To this end, contact arm 20 is itself U-shaped, with the open end of the U towards the outside, and has stamped out internal lateral edges 21 which penetrate the insulating sheath of conductor 6 when inserted in the direction of arrow F and retain the conductor in arm 20 in order to effect the electrical connection between conductor 6 and contact 2.

Contact arm 20 further comprises stamped out lugs 22 extending internally of contact 2 which grip the interior of compartment 11 of support 1 or 1' accommodating the contact arm in order to maintain the contact in position.

The other arm 23 of contact 2 is flat and has in an intermediate portion a deformation 24 forming a boss projecting outwardly of contact 2. This contact arm 23 is adapted to come into contact with one of pins 7, deformation 24 localizing the electrical contact area.

Contacts 2 are of an elastic metal and with advantage protected against corrosion by a surface coating, of tin-lead alloy, for example. As will be seen from FIG. 1 and FIGS. 5A and 6, corresponding to two transverse cross-sections through the terminal through consecutive contact compartments 11 and 12, the springs are inserted in their housing from the bottom surface of support 1 or 1' accommodating them, adjacent contacts being rotated through 180° relative to one another. Thus the contact arms 23 of consecutive contacts 2 on support 1 or 1' will be disposed in consecutive internal compartments 12 of the support, which alternate between the walls of groove 10, whereas contact arms 20 of consecutive contacts are located in external compartments 11 which alternate between the lateral surfaces of the support concerned. In view of the thickness of supports 1 and 1', which is selected so that the distance between the bottoms of the facing internal and external compartments is greater than the distance between arms 20 and 23 of contacts 2, contact arms 23 extend along the top of the respective internal compartments.

Supports 1 and 1' equipped with their contacts 2 are maintained in alignment by insulating member 3 and the locking up of the assembly by the cover 4, member 3 and cover 4 being disposed on supports 1 and 1', one nested within the other.

Referring in particular to FIG. 1, insulating member 3 is of inverted U-shape and its length is equal to the sum of the lengths of supports 1 and 1' it is to cover. It has two longitudinal bosses 30 adjacent its base, formed by increasing the thickness of the base and adjacent portions of its lateral arms. It also has two longitudinal ribs 31 projecting inwardly on its lateral arms. These ribs 31 maintain supports 1 and 1' in alignment by engagement in grooves 13 of the supports. Member 3 is deeper than supports 1 and 1' so that when it covers same it forms, as can be seen in FIGS. 3, 5A, 5B and 6, a free space 33 above them for accommodating conductors 6 to be connected to contacts 2.

Cover 4 is of a ferromagnetic conductive material, such as the steel available under trade reference Z8 C17. Like member 3 which it covers, cover 4 is of U-shape in cross-section and is formed with two longitudinal deformations on its lateral arms, corresponding to longitudinal bosses 30. It has at one end a lug 41 substantially aligned with its top surface, on which is disposed a collar 42 tightened by means of a screw 43 to retain the cable of which conductors 6 (FIGS. 3 and 4) are to connect to contacts 2. As can be seen in FIGS. 3 and 4, collar 42 also provides the electrical connection between cover 4, an electrical earth and the screen of the cable, by means of a screen continuity wire 61 terminating in a Faston terminal 62, cover 4 acting as an electromagnetic screen for the circuits contained within it.

At the end opposite lug 41 and collar 42, the front 44 of cover 4 is formed by a folded down portion of its top. Front 44 is formed with a circular aperture 45 to provide cam 5 with access to its housing in supports 1 and 1'. It is also formed with a small circular aperture 46 for maintaining cam 5 in the position in which the contacts are closed.

As previously mentioned, after insertion of member 3 in cover 4, the assembly 3–4 is mounted on supports 1 and 1' equipped with contacts 2.

Figure 5A:
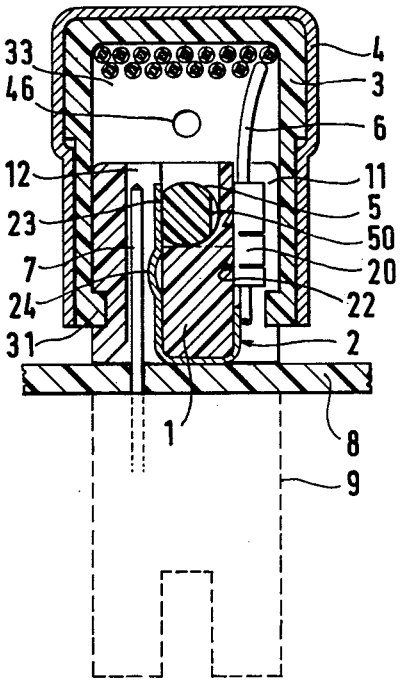
FIGS. 5A and 5B are two transverse cross-sections through the electrical connection terminal on the line V—V in FIG. 4, in respective "idle" and "contact" positions.
Figure 5B:
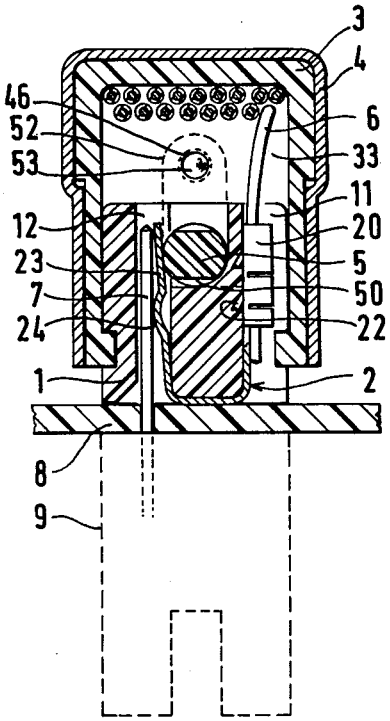
Figure 6:
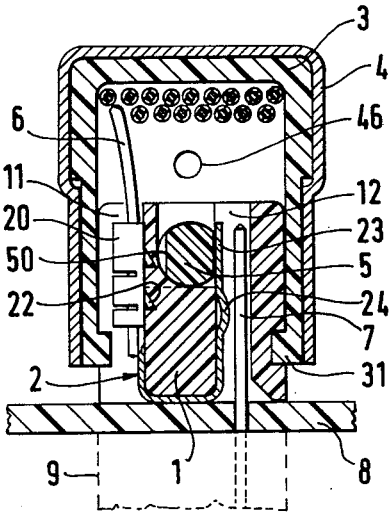
FIG. 6 is a transverse cross-section through the electrical connection terminal on the line VI—VI in FIG. 4, in the "idle" position.

Finally, the rigid terminal thus constructed further comprises its controlling cam 5. Referring in particular to FIG. 1, cam 5 is slightly longer than the assembly 3–4 covering supports 1 and 1'. It is generally cylindrical and is formed over virtually all its length with two diametrically opposed flats 50 (FIGS. 5A, 5B and 6). At one end which is rounded it has a peripheral groove 51, whereas the opposite end forms an actuator tab 52. This actuator tab is external of cover 4 and has a positioning pip 53 projecting towards front 44 of the cover and disposed substantially on the axial plane through the cam intersecting the flats and adapted to engage in opening 46 to maintain the cam in position.

Cam 5 is of an insulating material. It is inserted through opening 45 in front 44 of the cover into groove 10 in the supports, resting on the rounded bottom thereof, its rounded end projecting beyond supports 1 and 1'. The alignment of the supports is improved by the insertion of cam 5, which is maintained in position by a circlip 55 inserted in groove 51.

The resulting assembly constitutes a selectively operable connection terminal adapted to be inserted over pins 7, of the wire-wrap connection type, aligned in two rows as shown in FIGS. 3 and 4 and more particularly in FIG. 7. FIG. 7 shows four connecting terminals designated A, B, C and D, identical to each other and of the type shown in FIGS. 1, 3 and 4. These terminals are inserted or ready to be inserted over the double rows of pins 7 projecting from a printed circuit board 8, which may be a board for interconnecting circuits or electrical components or electronic components to be connected through the intermediary of the connecting terminals to various electrical cable conductors.

The operation of inserting each of the connecting terminals over pins 7 and the operation of the terminal will now be described in more detail with reference to FIGS. 5A, 5B and 6, which are cross-sections relating to FIG. 4.

These Figures show one of the contacts 2 of the connecting terminal connected to its conductor 6 and disposed in relation to one of the pins 7 upstanding from interconnection board 8. Like the other and similar pins, this pin 7 forms part of one or more electrical components 9 as schematically represented in dashed outline, such as a zero insertion force connector for printed circuit boards carrying various components, for example, effecting via individual contacts on the printed tracks on an edge of the board the input and output connections to the circuit on the board (not shown).

On mounting the connecting terminal on interconnecting board 8, pins 7 are inserted into the bottom of internal compartments 12 of contact support 1 or 1'. Such insertion is made possible by positioning arms 23 of contacts 2 along the top of their respective internal compartments 12, that is to say by actuation of cam 5 so that one of its flats faces arm 23 of each contact 2 which thus frees the bottom of its compartment. Arm 23 of contact 2 and pin 7, both located in the same internal compartment, are then not in contact with one another.

With the terminal mounted on interconnecting board 8, actuation of cam 5 by means of actuator tab 52 so as to insert pip 53 on the actuator tab into opening 46 on cover 4 brings the part-cylindrical portions of the cam against arms 23 of contacts 2. Under these conditions, the pressure exerted on these contact arms urges them towards the bottom of their compartment 12 and thus into contact with the respective pins 7.

It will be noted that by actuating the cam through 90° the connecting terminal may be set as required in an "idle" position, in which contacts 2 and pins 7 are not in contact and in which the terminal may be released from board 8, and a "contact" position in which pins 7 are connected to conductors 6.

It will be understood that various changes in the details, materials and arrangements of parts, which have been herein described and illustrated in order to explain the nature of the invention, may be made by those skilled in the art within the principle and scope of the invention as expressed in the appended claims.

For example, the acccompanying drawings show the terminal comprising two contact supports each adapted to accommodate 12 contacts. It is obvious that the terminal may comprise a different number of contact supports and that these may accommodate a different number of contacts. It will also be understood that it is possible to fit all or only some of contacts 2 to the support accommodating them, according to the disposition of pins 7 in the two rows of pins, to connect to an equal number of electrical conductors.

It is claimed:

1. A modular terminal for electrically connecting electrical conductors of a cable to rigid electrical terminal pins, comprising:

a plurality of generally U-shaped individual contacts each having one arm adapted to make contact via self-stripping edges with one electrical conductor and another flat arm adapted to press on and make contact with one of said pins;

at least one substantially parallelepipiedal contact support having a top surface and opposed lateral surfaces and further comprising a longitudinal internal groove having longitudinal walls which opens onto said top surface and having a rounded bottom surface, a series of external compartments along each of said lateral surfaces parallel to said internal groove and a series of internal compartments along each of the longitudinal walls of said groove which open onto said bottom surface, each of said external compartments on one side of said groove receiving the arm of one of said contacts adapted to make contact with the electrical conductor and being aligned with one of said internal compartments on the other side of said groove accommodating said flat contact arm extending along the top of said internal compartment and the corresponding pin extending along the bottom of said internal compartment;

an insulating member fixed to each contact support and formed with an internal space at the top adapted to house electrical conductors of a cable; and a generally cylindrical rotary cam formed with two diametrically opposed flats separated by part-cylindrical portions, mounted in the groove in each contact support in contact with said flat contact arms and bearing on said rounded bottom surface of said groove, whereby said contacts are pressed simultaneously into contact with respective pins when the part-cylindrical portions of said cam are brought into contact with said flat contact arms.

2. A terminal according to claim 1, further comprising a cover of ferromagnetic material mounted on said insulating member and covering said terminal.

3. A terminal according to claim 2, wherein said cover is electrically grounded by a screen continuity electrical wire.

4. A terminal according to claim 1, wherein said flat arm of each of said contacts has a deformation intermediate its ends forming a boss directed towards the outside of the contact.

5. A terminal according to claim 1, wherein each contact support has two lateral longitudinal grooves and said insulating member is U-shaped in cross-section terminating in two inwardly projecting longitudinal ribs engaged in said lateral grooves.

6. A terminal according to claim 1, wherein said cam has a peripheral groove at one end projecting outwardly of said terminal and an actuator tab at the opposite end, said terminal further comprising a circlip engaged in said peripheral groove whereby said cam is maintained in said internal groove between said circlip and said actuator tab.

7. A terminal according to claim 6, wherein said actuator tab has a projecting pip on its internal surface and said cover has a small opening in its front, said pip engage with said opening to maintain said cam in a position in which said contacts are closed.

8. A terminal according to claim 1, wherein said consecutive internal compartments and said consecutive external compartments along said internal groove alternate between opposite sides thereof.

* * * * *